US007874652B2

(12) United States Patent
Sugahara

(10) Patent No.: US 7,874,652 B2
(45) Date of Patent: Jan. 25, 2011

(54) LIQUID TRANSPORTING APPARATUS AND INK-JET PRINTER

(75) Inventor: Hiroto Sugahara, Aichi-ken (JP)

(73) Assignee: Brother Kogyo Kabushiki Kaisha, Aichi-Ken (JP)

( * ) Notice: Subject to any disclaimer, the term of this patent is extended or adjusted under 35 U.S.C. 154(b) by 847 days.

(21) Appl. No.: 11/888,227

(22) Filed: Jul. 31, 2007

(65) Prior Publication Data

US 2008/0030554 A1 Feb. 7, 2008

(30) Foreign Application Priority Data

Aug. 2, 2006 (JP) ..... 2006-211174

(51) Int. Cl.
*B41J 2/045* (2006.01)

(52) U.S. Cl. ..... 347/70

(58) Field of Classification Search ..... 347/70
See application file for complete search history.

(56) References Cited

U.S. PATENT DOCUMENTS

| | | | |
|---|---|---|---|
| 2005/0052486 A1 | 3/2005 | Kodama | |
| 2005/0285911 A1 | 12/2005 | Sugahara | |

FOREIGN PATENT DOCUMENTS

| | | | |
|---|---|---|---|
| JP | 2000094674 | | 4/2000 |
| JP | 2000198192 | * | 7/2000 |
| JP | 20000198192 | | 7/2000 |
| JP | 2005104135 | | 4/2005 |
| JP | 2005144594 | | 6/2005 |
| JP | 2006-44242 | | 2/2006 |

* cited by examiner

*Primary Examiner*—Jerry T Rahll
(74) *Attorney, Agent, or Firm*—Frommer Lawrence & Haug LLP

(57) ABSTRACT

A liquid transporting apparatus includes a channel unit in which a plurality of pressure chambers are provided, and a piezoelectric actuator which changes individually a volume of each of the pressure chambers. The piezoelectric actuator includes a vibration plate, a piezoelectric body provided on one surface of the vibration plate, and electrodes which apply an electric voltage to the piezoelectric body. The other surface of the vibration plate is joined to the channel unit to close openings of the pressure chambers, and the one surface of the vibration plate includes an uncovered area which is not covered with the piezoelectric body. Since a heater is provided in the uncovered area, and an electrode for applying an electric current is provided separately from the electrodes of the piezoelectric actuator, it is possible to operate the heater even when the piezoelectric actuator is being driven.

17 Claims, 14 Drawing Sheets

LIQUID TRANSPORTING APPARATUS AND INK-JET PRINTER

CROSS-REFERENCE TO RELATED APPLICATION

The present application claims priority from Japanese Patent Application No. 2006-211174, filed on Aug. 2, 2006, the disclosure of which are incorporated herein by reference in its entirety.

BACKGROUND OF THE INVENTION

1. Field of the Invention

The present invention relates to a liquid transporting apparatus which transports a liquid from a liquid supply port up to a plurality of liquid jetting ports, and an ink-jet printer.

2. Description of the Related Art

An ink-jet head which transports an ink supplied from an ink tank, and jets ink droplets from nozzles to a recording paper or the like has already been known. Ink-jetting methods are classified according to a difference in a method for generating jetting energy. There are ink-jetting methods such as a piezo method in which ink droplets are jetted by using a vibration force of a piezoelectric element, and a Bubble Jet® method in which ink droplets are jetted by generation of air bubbles by heat energy. Among these, the piezo method has advantages (merits) such as a high degree of freedom of selecting types of ink, a possibility of a liquid droplet gradation by controlling precisely jetting amount of the ink, and a high durability, since a mechanical power is used as the jetting energy.

For example, An ink-jet head of the piezo method disclosed in Japanese Patent Application Laid-open No. 2006-44242, includes a channel unit which is provided with a plurality of pressure chambers, in channels from an ink supply port up to a plurality of nozzles, corresponding to each of the nozzles, and a piezoelectric actuator which is stacked on the channel unit, and which selectively changes a volume of each of the pressure chambers. Moreover, the piezoelectric actuator has a vibration plate which serves as a common electrode, a piezoelectric layer which is formed on an upper surface of the vibration plate, and a plurality of individual electrodes which are formed on an upper surface of the piezoelectric layer, corresponding to the pressure chambers respectively.

According to such ink-jet head, when a drive voltage is selectively applied to one of the individual electrodes of the piezoelectric actuator, an electric field acts in a portion (active portion) of the piezoelectric layer sandwiched between the individual electrode and the common electrode, and there occurs a deformation in a direction of thickness of the piezoelectric layer. Moreover, this deformation of the piezoelectric layer is propagated to the vibration plate, and a volume of a pressure chamber corresponding to the individual electrode is changed. Due to a pressure fluctuation generated in an ink inside the pressure chamber, ink droplets are jetted from a nozzle corresponding to the pressure chamber.

However, when an environmental temperature is low, since a viscosity of an ink in the ink-jet head becomes high, if it is intended to jet from the nozzles, ink droplets similar as ink droplets at a high temperature, it is necessary to increase the pressure fluctuation inside the pressure chamber by increasing the drive voltage of the piezoelectric actuator. When the drive voltage of the piezoelectric actuator is increased, electrical components which can withstand high voltage are to be used as electrical components which are connected to the ink-jet head, and this leads to an increase in an overall cost.

In Japanese Patent Application Laid-open No. 2000-198192, an ink-jet head, in which a heater made of a high-resistance material is provided to a part of a common electrode on a lower portion of the piezoelectric actuator, has been disclosed. In this ink-jet head, piezoelectric vibrator and an individual electrode (upper electrode) are stacked on the heater, with an object of preventing malfunctioning of the piezoelectric vibrator due to dew formation (dew condensation). In a case of this ink-jet head, the heater is formed on a part of the common electrode, and it is necessary to apply an electric current to the common electrode for making the heater generate heat. Therefore, it is not possible to make the heater generate heat simultaneously with driving of the piezoelectric actuator for which it is necessary to keep an electric potential of the common electrode zero.

SUMMARY OF THE INVENTION

The present invention is made in view of the abovementioned circumstances, and an object of the present invention is to improve a degree of freedom of an operation timing of the heater, and to improve a heating efficiency of an ink (liquid).

According to a first aspect of the present invention, there is provided a liquid transporting apparatus which transports a liquid from a liquid supply port to a plurality of liquid jetting ports, including: a plurality of pressure chambers which are formed, corresponding to the plurality of liquid jetting ports respectively, in channels each from the liquid supply port up to one of the liquid jetting ports; a channel unit in which the pressure chambers open; and a piezoelectric actuator which changes a volume of each of the pressure chambers individually; and the piezoelectric actuator includes a vibration plate, a piezoelectric body which provided on one surface of the vibration plate, a first electrode provided on a surface, of the piezoelectric body, on a side of the vibration plate, and a second electrode provided, on the piezoelectric body, on the other surface not facing the vibration plate, and which is joined to the channel unit such that the other surface of the vibration plate closes openings of the pressure chambers, and the one surface of the vibration plate has an uncovered area which is not covered by the piezoelectric body, and a heater is provided in the uncovered area, the heater generating heat by being applied with an electric current, and an electrode for applying the electric current to the heater is provided independently of the first electrode and the second electrode of the piezoelectric actuator.

According to the liquid transporting apparatus of the present invention, since the electrode for applying the electric current to the heater is independent of the first electrode and the second electrode of the piezoelectric actuator, it is possible to heat a liquid in the channels by the heater even when the piezoelectric actuator is in operation. Consequently, a degree of freedom of an operation timing of the heater is improved. Moreover, since the heater is provided in the uncovered area on the vibration plate which is not covered by the piezoelectric body, heat of the heater is propagated to the vibration plate without being drawn by the piezoelectric body. Consequently, the heat of the heater is directly propagated to the liquid inside the channel efficiently via the vibration plate, and a heating efficiency of the liquid is improved. The present invention is not restricted to a structure in which the vibration plate and the first electrode are formed individually, and also includes a structure in which the vibration plate is electroconductive and serves as the first electrode.

In the present invention, the pressure chambers may be arranged along a predetermined direction in a plan view, and the heater may extend in the predetermined direction at a position beside each of the pressure chambers in a plan view. When such an arrangement is made, since the heater extends at a position beside each of the pressure chambers in which there is a liquid, the heater heats evenly the liquid in each of the channels along all pressure chambers. Consequently, it is possible to prevent developing of a difference in viscosity of liquids which are jetted from the liquid jetting ports. In the present invention, the "plan view" means observing visually from a direction orthogonal to a surface of the vibration plate.

In the present invention, the channel unit may include a common liquid chamber which communicates with the liquid supply port; and each of the pressure chambers may have an inflow hole, at one end portion thereof, which communicates with the common liquid chamber, and may have an outflow hole, at the other end portion thereof, which communicates with one of the liquid jetting ports. The heater may be provided closer to the one end portion of each of the pressure chambers, than the other end portion of the pressure chamber. Liquid in a channel connected from the inflow hole of one of the pressure chambers to one of the liquid jetting ports corresponding to the pressure chamber may be discarded (wasted) by flushing (cleaning) at a time of start-up of the liquid transporting apparatus, and the heating may be wasted. However, according to the present invention, since the heater is provided closer to the inflow hole which communicates with the common liquid chamber than the outflow hole which communicates with the liquid jetting port of the pressure chamber, it is possible to heat the liquid efficiently.

In the present invention, the common liquid chamber may be arranged at a side of the heater such that the common liquid chamber overlaps with the inflow hole of each of the pressure chambers in a plan view, and that the common liquid chamber does not overlap with the outflow hole of each of the pressure chambers in a plan view. By making such an arrangement, since the heat of the heater is propagated directly to the liquid in the common liquid chamber communicating with the inflow hole, without being passed through the outflow hole which communicates with the liquid jetting port, the heating efficiency is improved and it is possible to shorten a heating time. Moreover, since the common liquid chamber is heated sufficiently, it is possible to prevent developing the difference in viscosity of liquids which are jetted from the liquid jetting ports.

In the present invention, the heater may include a heating element which is formed of a heat generating material generating heat by being applied with the electric current, and which is provided on a side of the one surface of the vibration plate; and the electrode for applying the electric current to the heater may be provided as a plurality of electrodes of the heater which apply the electric current to the heating element on a surface, of the heating element, not facing the vibration plate. In this case, since the electrodes which apply the electric current to the heating element are provided on the surface of the heating element not facing the vibration plate, it is possible to connect the electrodes and terminals of a wire member for supplying an electric power easily.

In the present invention, the one surface of the vibration plate may be non-conductive at least at a portion thereof at which the heating element is formed. In this case, since the electric power supplied to the heater does not reach up to the vibration plate, it is possible to carry out the heating by the heater efficiently.

In the present invention, the vibration plate may be made of an electroconductive material; the heater may include a heating element formed, of a heat generating material which generates heat by being applied with an electric current, so as to make a contact with the one surface of the vibration plate, and an electrode which is formed over an entire surface of the heating element not facing the vibration plate; and the heating element may be heated by a voltage applied between the vibration plate and electrode of the heater. In this case, since the vibration plate serves as the electrode for the heater, and the electric current is applied to a substantial area in (of) the heating element between the electrode on the heating element and the vibration plate, the heating efficiency of the heater is improved.

In the present invention, the second electrode and the plurality of electrodes of the heater may be arranged on a same plane. In this case, it is possible to connect flatly, terminals of the wire member (for example flexible flat cable) for supplying the electric power easily. Consequently, a structure of wiring to the piezoelectric actuator is simplified, and it is possible to facilitate a cost reduction.

In the present invention, a surface electrode which is in electric conduction with the first electrode may be arranged on a same plane as the second electrode and the plurality of electrodes of the heater. In this case, it is possible to connect flatly, the terminals of the wire member for supplying the electric power easily, to the electrodes of the heater and the first electrode and the second electrode of the piezoelectric actuator. Consequently, the structure of wiring to the piezoelectric actuator is simplified, and it is possible to facilitate the cost reduction.

In the present invention, the heating element may be formed by adhering (attaching) the heat generating material to the one surface of the vibration plate; and the piezoelectric body may be formed by adhering a piezoelectric material to the one surface of the vibration plate; and a film forming method of forming the heating element may be same as a film forming method for forming the piezoelectric body. For example, the film forming method may be an aerosol deposition method. In this case, since it is possible to form the piezoelectric body and the heater by using a similar film forming apparatus at the time of manufacturing the piezoelectric actuator of the liquid transporting apparatus, a manufacturing line is simplified and a manufacturing efficiency is improved. Furthermore, since the heater is adhered directly to the vibration plate by the film forming method, and not by sticking on the vibration plate, the vibration plate is heated directly without the heat being passed through an adhesive which normally has low heat conductivity. Consequently, the heating efficiency of the liquid via the vibration plate is improved.

In the present invention, the heater may be provided as two heaters arranged to sandwich all the channels of the channel unit in a plan view. In this case, since the liquid inside the channels of the channel unit is heated evenly and promptly, it is possible to heat evenly the liquid inside the channels in the channel unit and to shorten the heating time. Moreover, at least two heaters may be arranged to be divided on both sides sandwiching the all channels of the channel unit, or three or more heaters may be provided.

In the present invention, the vibration plate may serve as the first electrode. In this case, since the first electrode is not required to be provided separately, it is possible to reduce manufacturing steps of the piezoelectric actuator.

According to a second aspect of the present invention, there is provided an ink-jet printer including: the liquid transporting apparatus, as defined in the first aspect; and a moving mechanism which moves the liquid transporting apparatus in a direction in which the two heaters are separated.

When the liquid transporting apparatus which is an ink-jet head is reciprocated, portions on both sides of the scanning direction of the liquid transporting apparatus are susceptible to be cooled by wind due to a movement. However, according to the ink-jet printer of the present invention, by arranging the two heaters to be separated (isolated) on both sides of the scanning direction, it is possible to heat effectively, locations which are susceptible to be cooled.

According to a third aspect of the present invention, there is provided an ink-jet printer including: the liquid transporting apparatus as defined in the first aspect; a controller which controls the heater; and a connecting cable which electrically connects the controller and the liquid transporting apparatus.

According to the ink-jet printer of the present invention, by connecting electrically the controller and the liquid transporting apparatus via the connecting cable, it is possible to control the heater of the liquid transporting apparatus by the controller.

In the present invention, the connecting cable may be connected to the electrode for applying the electric current to the heater provided in the uncovered area. In this case, since the electrode for applying the electric current to the heater is provided in the uncovered area of a vibration plate, it is possible to connect the connecting cable easily.

In the present invention, the liquid transporting apparatus may further include a temperature sensor; and the controller may control the heater based on a temperature measured by the temperature sensor. In this case, by controlling the heater according the temperature measured by the temperature sensor, it is possible to maintain the temperature of ink to be constant. Therefore, the ink-jet printer of the present invention is capable of maintaining a viscosity of the ink to be constant, and is capable of jetting the ink stably.

DETAILED DESCRIPTION OF THE PREFERRED EMBODIMENTS

Embodiments of the present invention will be described below by referring to the accompanying diagrams.

Figure 1:
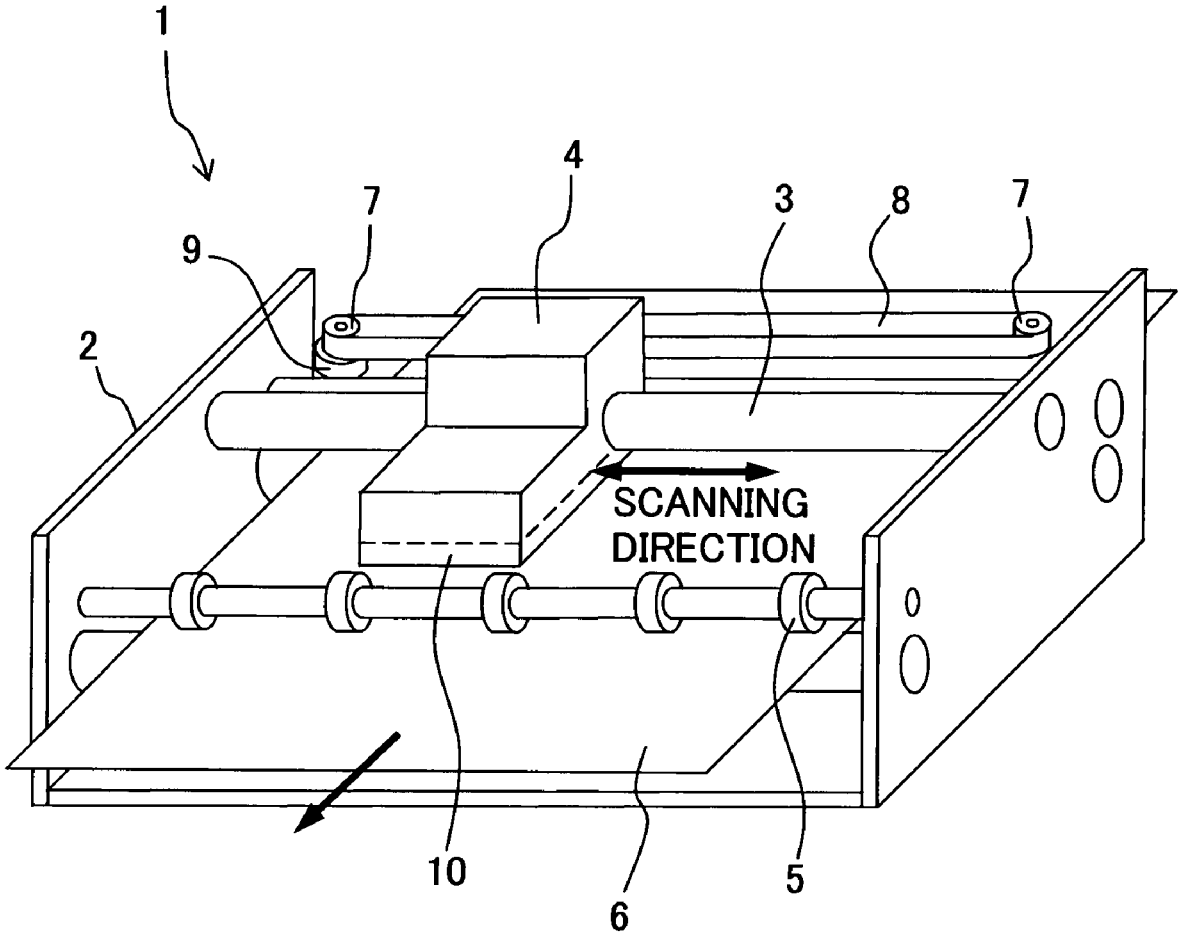
FIG. 1 is a schematic perspective view of an ink-jet printer according to a first embodiment of the present invention.

FIG. 1 is a schematic perspective view of an ink-jet printer 1 according to a first embodiment of the present invention. As shown in FIG. 1, the ink-jet printer 1 includes a guide rod 3 installed in a housing 2, and a carriage 4 is slidably supported by the guide rod 3. An ink-jet head 10 (liquid transporting apparatus) is provided at a lower portion of the carriage 4, and an ink is jetted from the ink-jet head 10 toward a recording paper 6 which is transported by paper feeding rollers 5, under the ink-jet head 10. The carriage 4 is joined to a timing belt which is put around a pair of pulleys 7, and the timing belt is arranged parallel to an axial direction of the guide rod 3. A motor 9 which is driven to perform reciprocal rotation (normal and reverse rotation) is provided on one of the pulleys 7, the timing belt 8 is reciprocated by the pulley 7 being driven to perform reciprocal rotation, and the ink-jet head 10 installed on the carriage 4 is moved along the guide road 3. In other words, a moving mechanism of the ink-jet head 10 includes the guide rod 3, the carriage 4, the pulleys 7, the timing belt 8, and the motor 9.

Figure 2:
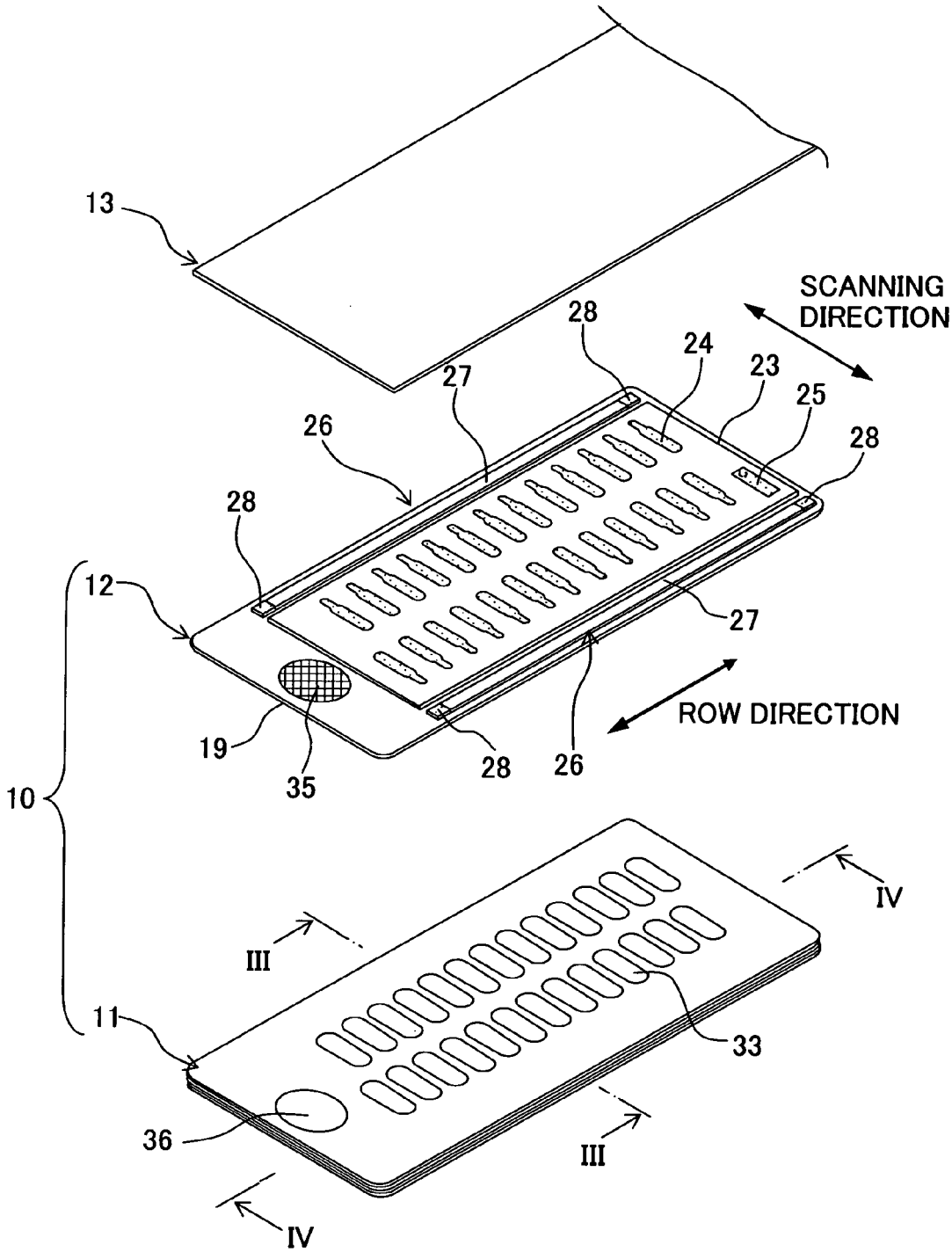
FIG. 2 is an exploded perspective view of an ink-jet head used in the ink-jet printer shown in FIG. 1.

FIG. 2 is an exploded perspective view of the ink-jet head 10 which is used in the ink-jet printer 1 used in FIG. 1. In the following description, a "scanning direction" is a direction in which the carriage 4 moves, and a "row direction" is a direction in which pressure chambers 33 which will be described later are arranged (a direction of arrangement of nozzle holes 18*a*), and a direction orthogonal to the scanning direction. As shown in FIG. 2, the ink-jet head 10 includes a channel unit 11 in which a plurality of plates are stacked, and a piezoelectric actuator 12 which is adhered to the channel unit 11 to overlap with the channel unit 11. In the channel unit 11, the ink is jetted downward from the nozzle holes 18*a* opening in a lower surface side of the lowermost layer (refer to FIG. 3). The piezoelectric actuator 12 includes a vibration plate 19 which is arranged facing the channel unit 11, a common electrode 22 (first electrode, refer to FIG. 3) which will be described later, which is formed on an upper surface of the vibration plate 19, a piezoelectric body 23 which is provided to cover an upper surface of the common electrode 22, and a plurality of individual electrodes 24 (second electrodes) arranged on an upper surface of the piezoelectric body 23. A surface electrode 25 which is in electric conduction with the common electrode 22 (refer to FIG. 3) is formed at a desired location on the upper surface of the piezoelectric body 23.

On the vibration plate 19, a heater 26, in which electrodes 28 are formed on an upper surface of both end portions of a heating element 27 is formed, extends along the row direction at both sides of the scanning direction of the piezoelectric body 23, respectively. On an upper surface of the piezoelectric actuator 12, a flexible flat cable 13 for connecting electrically to an external equipment is arranged to overlap with the piezoelectric actuator 12, and a terminal which is exposed on a lower side of the flexible flat cable 13 is connected to be in electric conduction with each of the electrodes 24 and 25 of the piezoelectric actuator 12, and the electrodes 28 of the heater 26. Moreover, an ink supply port 35 (liquid supply port) which is covered by a filter in a form of a mesh is formed on the vibration plate 19, and an ink supply port 36 communicating with the ink supply port 35 is formed in the channel unit 11.

Figure 3:
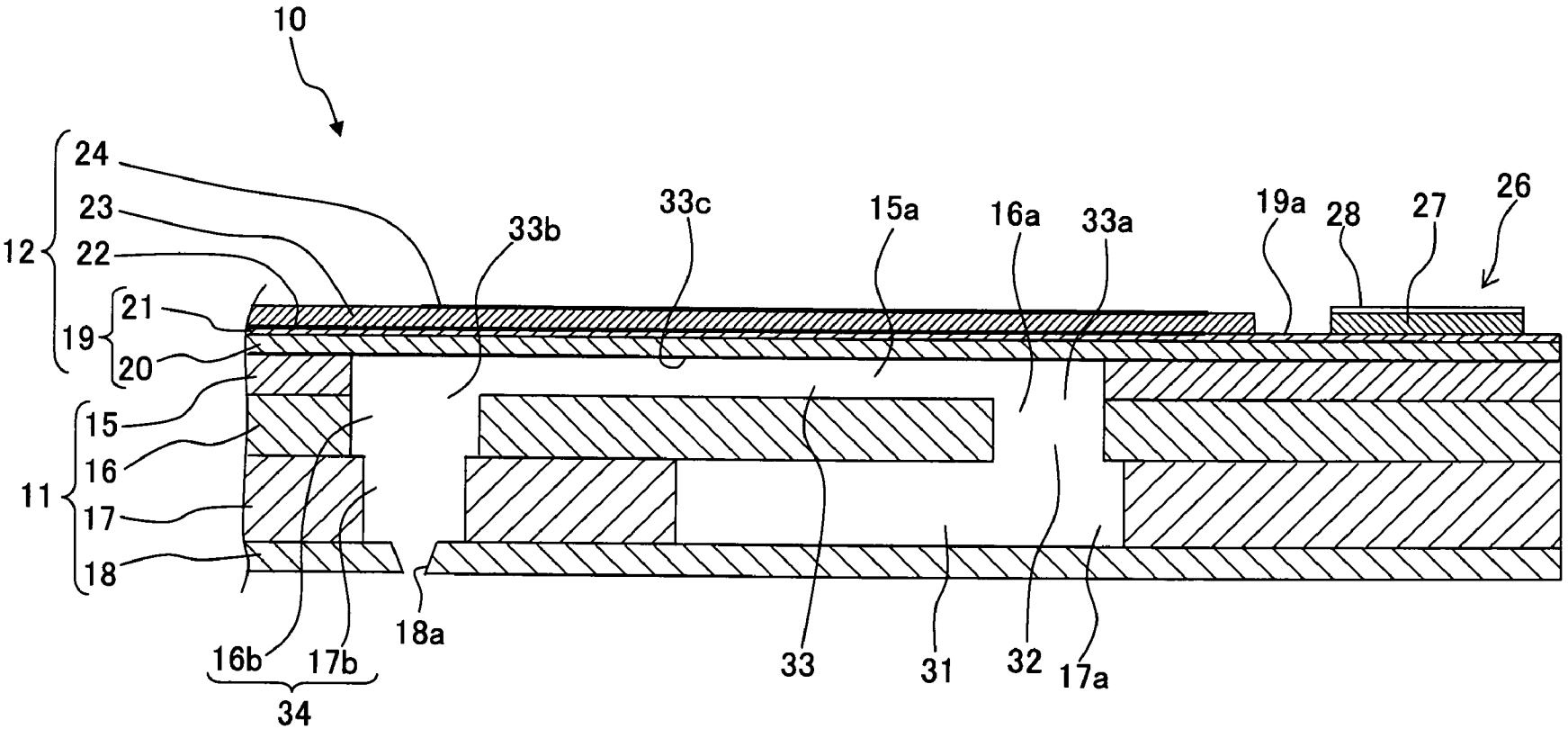
FIG. 3 is an enlarged cross-sectional view of main components, taken along a line III-III in FIG. 2.
Figure 4:
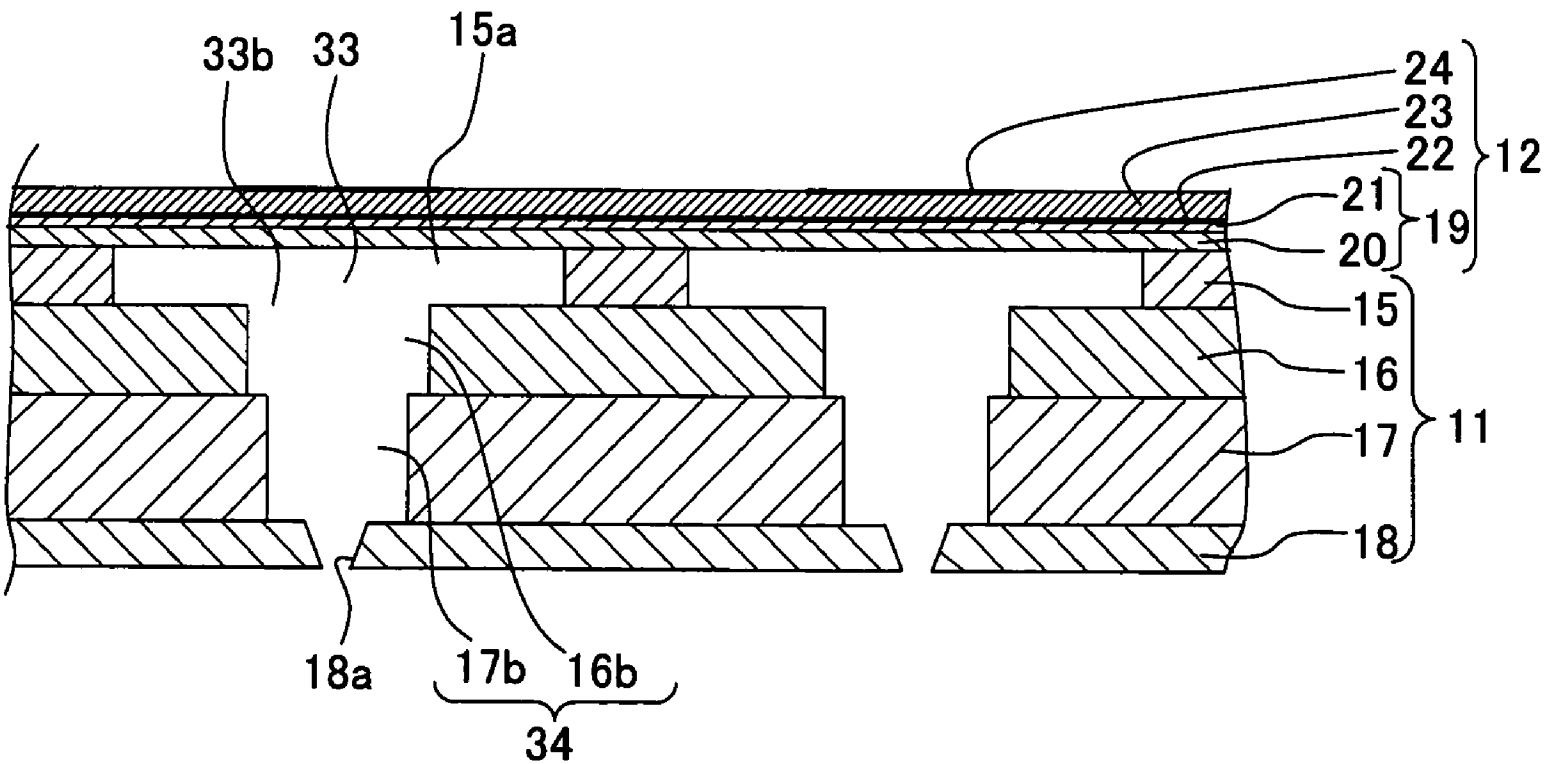
FIG. 4 is an enlarged cross-sectional view of main components, taken along a line IV-IV in FIG. 2.

FIG. 3 is an enlarged cross-sectional view of main components, taken along a line III-III in FIG. 2. FIG. 4 is an enlarged cross-sectional view of main components, taken along a line IV-IV in FIG. 2. As shown in FIG. 3 and FIG. 4, the channel unit 11 has a structure in which a pressure chamber plate 15, a connecting channel plate 16, a manifold plate 17, and a nozzle plate 18 are stacked and adhered. The nozzle plate 18 is a sheet of a resin such as polyimide, and openings which form the channels are formed by laser processing, and each of the remaining plates 15 to 17 is a metallic plate of a metal such as stainless steel, and openings which form the channels are formed by an etching or the like.

The pressure chamber plate 15 has a plurality of pressure chamber holes 15*a* arranged in two rows along a long side in a plan view (observed from a direction orthogonal to a surface of the vibration plate 19). Each of the pressure chamber holes 15*a* has an elliptical shape having a long axis in the scanning direction (direction orthogonal to the row direction) in a plan view (refer to FIG. 5). The connecting channel plate 16 has a plurality of communicating holes 16*a* each of which communicates with one end portion of one of the pressure chamber holes 15*a*, and a plurality of through holes for outflow 16*b* each of which communicates with the other end portion of one of the pressure chamber holes 15*a*. The manifold plate 17 has a manifold hole 17*a* which extends in the row direction, to communicate with each of the rows of the pressure chamber holes 15*a*, and a plurality of through holes for outflow 17*b* each of which communicates with each of the through holes for outflow 16*b*. The nozzle plate 18 has a plurality of nozzle holes (liquid jetting ports) 18*a* each of which communicates with each of the through holes for outflow 17*b*, and jets the ink to an outside.

Next, the ink channels inside the channel unit 11 will be described below. As shown in FIG. 3, a common liquid chamber 31 is formed by an upper side and a lower side (a top and a bottom) of the manifold hole 17*a* being closed by the connecting channel plate 16 and the nozzle plate 18. The common liquid chamber 31 communicates with the ink supply ports 35 and 36 (refer to FIG. 2) to which the ink is supplied from an ink tank (not shown in the diagram). The common liquid chamber 31 communicates with one end portion of each of the pressure chamber holes 15*a* on an upper side via the connecting channels 32 formed by the communicating holes 16*a* of the connecting channel plate 16. A plurality of pressure chambers 33 are formed by an upper side and a lower side (a top and a bottom) of the pressure chamber holes 15*a* being closed by the vibration plate 19 and the connecting channel plate 16. In other words, an inflow hole 33*a* which communicates with the common liquid chamber 31 is formed at one end portion of each of the pressure chambers 33, and an opening 33*c* at an upper portion of each of the pressure chambers 33 is closed by the vibration plate 19. Here, the common liquid chamber 31 is protruded (projected) toward the heater 26 farther than the pressure chamber 33 and the connecting channel 32. The other end portion of each of the pressure chambers 33 communicates with a descender 34 which is formed by one of the through holes for outflow 16*b* and one of the through holes for outflow 17*b*. In other words, an outflow hole 33*b* which communicates with one of the nozzle holes 18*a*, is provided in the other end portion of each of the pressure chambers 33. The descender 34 is formed vertically such that a diameter goes on decreasing gradually toward one of the nozzle holes 18*a* on the lower side.

The piezoelectric actuator 12 includes the vibration plate 19 which is adhered to overlap with the upper surface of the channel unit 11. The vibration plate 19 includes a vibration plate main body 20 which is formed of a metallic plate of a metal such as stainless steel, and an insulating layer 21 formed of a material such as alumina, which is formed as a film, on an upper surface of the vibration plate main body 20. The common electrode (first electrode) 22 which is arranged continuously corresponding to the plurality of pressure chamber holes 15*a* is formed by printing on the upper surface of the vibration plate 19. The piezoelectric body 23 in a form of a sheet made of a ceramics material of lead zirconate titanate (PZT) is formed on an upper surface of the common electrode 22. The piezoelectric body 23 is formed on the vibration plate 19 and the common electrode 22 without using an adhesive, by a film forming method such as an aerosol deposition method, a sputtering method, a vapor deposition method, and a sol-gel method. Moreover, as shown in FIG. 4, the piezoelectric body 23 covers the common electrode 22 entirely, and is formed in a range such that an uncovered area 19*a* which is not covered by the piezoelectric body 23 is provided along both sides of the scanning direction of the vibration plate 19, respectively. A plurality of the individual electrodes (second electrodes) 24 which are arranged to correspond with the pressure chamber holes 15*a* respectively are formed in two rows by printing on an upper surface of the piezoelectric body 23. The heater 26 extends along a row direction of the pressure chamber holes 15*a* having a distance (an interval) from the piezoelectric body 23, in one of the uncovered areas 19*a* of the vibration plate 19.

Figure 5:
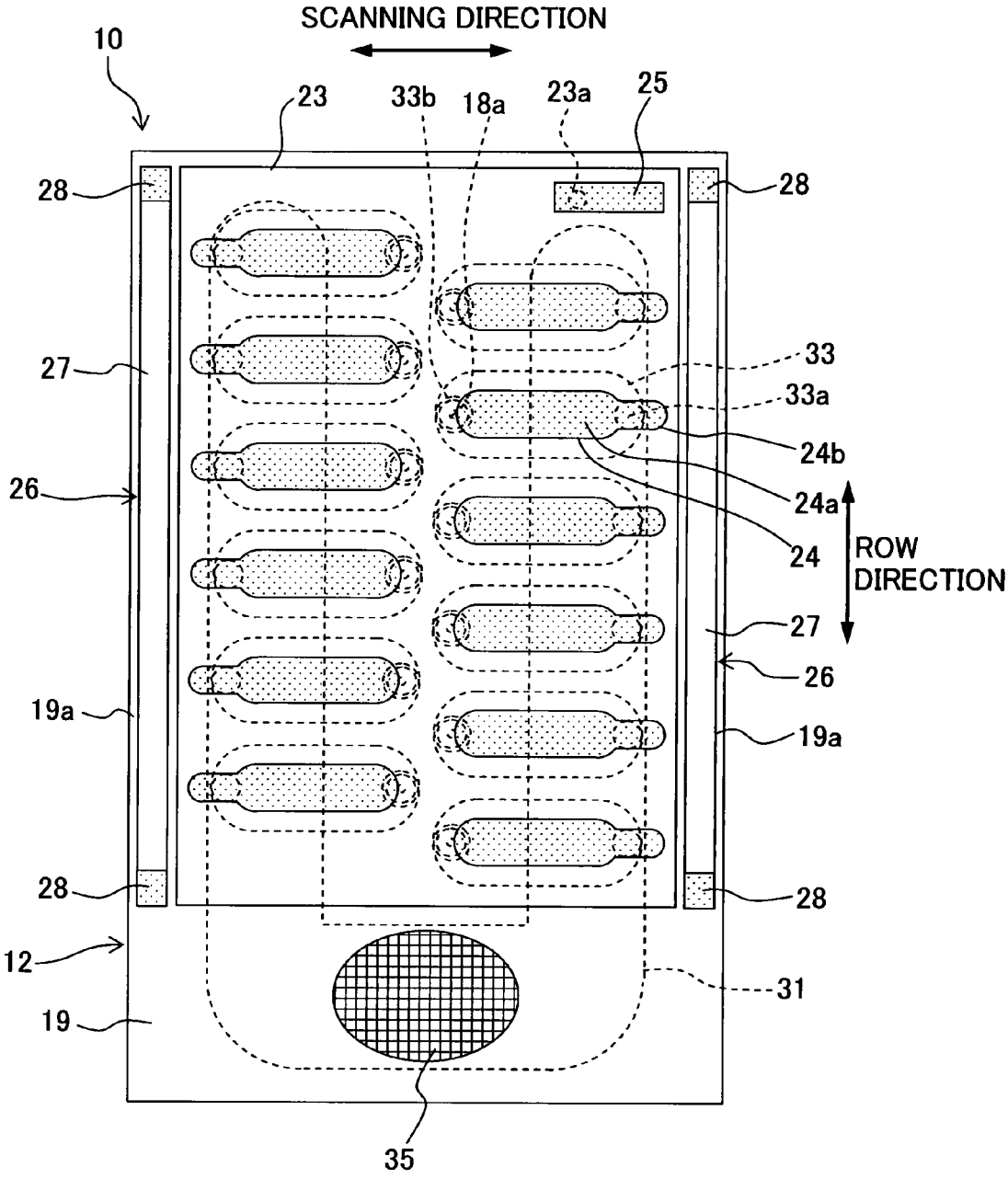
FIG. 5 is a plan view of the ink-jet head shown in FIG. 2.

FIG. 5 is a plan view of the ink-jet head 10 shown in FIG. 2. (In FIG. 5, for better viewability, the individual electrodes 24, and the pressure chambers 33 are shown to be larger than actual size). As shown in FIG. 5, the vibration plate 19 is substantially rectangular shaped in a plan view, and the piezoelectric body 23 is substantially rectangular shaped having an area smaller than an area of the vibration plate 19 in a plan view, and the uncovered area 19*a* which is not covered by the piezoelectric body 23 is formed on the vibration plate 19, at both sides of the scanning direction, respectively. The heater 26 is installed in the uncovered area 19*a*, to extends in the row direction with a substantially same thickness as of the piezoelectric body 23. The heater 26 includes the heating element 27 having a band shape, which generates heat by being applied with an electric current, and the electrodes 28 which are formed on an upper surface of both end portions of the heating element 27. The heating element 27 is formed by adhering, directly to the vibration plate 19, a heat generating material made of a material such as graphite, carbon, PG/PBN (pyrolytic graphite/pyrolytic boron nitride), aluminum nitride, or tungsten, by a film forming method such as the aerosol deposition method, the sputtering method, the vapor deposition method, or the sol-gel method. In the first embodiment, as a film forming method for forming the heating element 27 of the heater 26, a method same as the film forming method for forming the piezoelectric body 23 is used.

Each of the individual electrodes 24 includes a main-body portion 24*a* having a similar shape as the shape of each of the pressure chambers 33 in a plan view, and an area smaller than the area of the pressure chamber 33, and a terminal 24*b* which extends from the main-body portion 24*a* up to an outside of the pressure chamber 33 toward the heater 26. In each of the two rows of the pressure chambers 33, the inflow holes 33*a* are arranged at one end portions of the pressure chambers 33 on a side of mutual separation of the two rows, in other words, at positions close to the heater 26. Moreover, in each of the two rows of the pressure chambers 33, the outflow holes 33*b* are arranged at the other end portions of the pressure chambers 33 on a side of mutually nearing of the two rows, in other words, at positions away from the heater 26. The common liquid chamber 31 extends in the row direction at a position near the heater 26 such that the common liquid chamber 31 overlaps with the inflow holes 33*a* of the pressure chamber 33 and that the common liquid chamber 31 does not overlap with the outflow holes 33*b* of the pressure chambers 33 in a plan view, and the common liquid chamber 31 is arranged to project (protrude) toward the heater 26 farther than the pressure chambers 33 in a plan view. Furthermore, the surface electrode 25 is formed by printing, on the upper surface of the piezoelectric body 23, and the surface electrode 25 is in electric conduction with the common electrode 22 (refer to FIG. 3) via an intermediate electroconductive body (not shown in the diagram) provided in a through hole 23*a* of the piezoelectric body 23.

Figure 6:
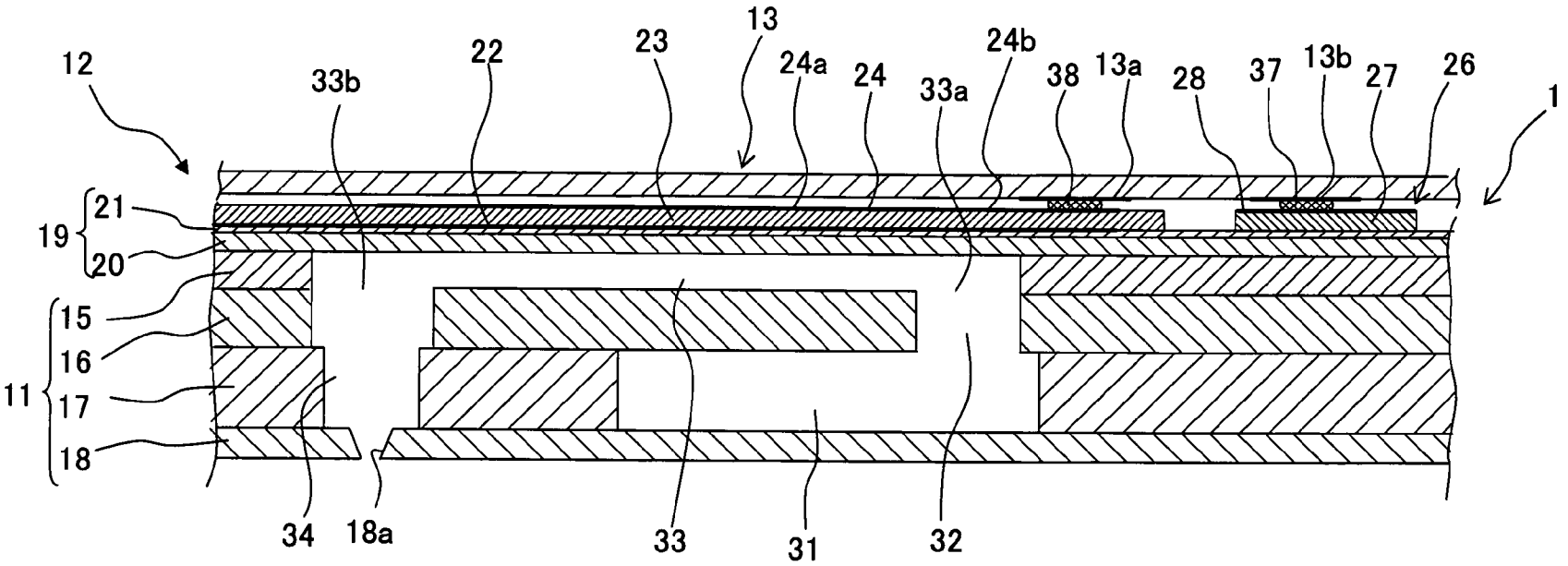
FIG. 6 is cross-sectional view of a state in which a flexible flat cable is connected to the ink-jet head shown in FIG. 3.

FIG. 6 is a cross-sectional view of a state in which the flexible flat cable 13 is connected to the ink-jet head 10 shown in FIG. 3. As shown in FIG. 6, the flexible flat cable 13 has terminals 13*a* and 13*b* exposed at desired locations on a lower surface thereof. The terminals 13*a* and 13*b* of the flexible flat cable 13 are connected to be electrically conductive with the terminals 24*b* of the individual electrodes 24, and the surface electrode 25 and the electrodes 28 of the heaters 26 (refer to FIG. 5) via electroconductive joining (connecting) members 37 and 38 such as a solder. In other words, since the terminals 24*b* of the individual electrodes 24, and the surface electrode 25 and the electrodes 28 of the heaters 26 are arranged on the same plane, they are easily and stably joined to one flexible flat cable 13.

Next, an effect of the ink-jet head 10 will be described below. As shown in FIG. 6, by generation of an electric potential difference between one of the individual electrodes 24 and the common electrode 22 when a voltage is selectively applied to the individual electrode 24, an electric field acts (is generated) in an active portion between the common electrode 22 and the individual electrode 24 of the piezoelectric body 23, and the active portion is contracted in a direction orthogonal to the direction of stacking. Due to the contraction of the active portion, the vibration plate 19 is deformed to form a projection toward inside of the pressure chamber 33 corresponding to the individual electrode 24. Due to the deformation of the vibration plate 19, a pressure is applied to the ink in the pressure chamber 33 and the ink is jetted from the nozzle hole 18 corresponding to the pressure chamber 33 upon passing through the descender 34. However, at a low temperature, since a viscosity of the ink in the channel unit 11 is increased and there is a change in jetting characteristics, the channel unit 11 is heated by supplying an electric power to the heaters 26 via the flexible flat cable 13.

Concretely, the heating element 27 of each of the heaters 26 generates heat due to the electric current being applied, and the vibration plate 19 is heated directly. Since the vibration plate 19 is made of a metallic plate of a metal such as stainless steel, and an insulating layer is made of a material such as alumina, the heat conductivity is favorable. Moreover, the heat from the vibration plate 19 is propagated to the pressure chamber 33, the connecting channel 32, and the common liquid chamber 31 via the pressure chamber plate 15, the connecting channel plate 16, and the manifold plate 17 which are metallic plates, and the ink in the pressure chambers 33, the connecting channels 32, and the common liquid chamber 31 is heated.

At this time, since the electrodes 28 for applying the electric current to the heating element 27 of each of the heaters 26 are independent of the common electrode 22 and the individual electrodes 24 of the piezoelectric actuator 12, it is possible to heat the ink in the channel unit 11 by the heaters 26 even when the piezoelectric actuator 12 is in operation, and a degree of freedom of operation timing of the heaters 26 is improved. Moreover, since the heaters 26 are provided in the uncovered areas 19*a* respectively on the vibration plate 19, which is not covered by the piezoelectric body 23, the heat of the heaters 26 is propagated to the vibration plate 19 without being drawn by the piezoelectric body 23, and an efficiency of a heat transfer to the ink in the channel unit 11 is improved.

The ink inside the descenders 34 may be discarded (wasted) by flushing (cleaning) at a time of start-up of the printer, but since the heaters 26 are provided at positions closer to the common liquid chamber 31 than the descenders 34, it is possible to heat the ink effectively. Moreover, the common liquid chamber 31 arranged at a side of the heater 26 such that the common liquid chamber 31 overlaps with the inflow holes 33*a* of the pressure chambers 33 and that the common liquid chamber 31 does not overlap with the outflow holes 33*b* of the pressure chambers 33 in a plan view. Therefore, the heat of the heater 26 is propagated directly to the ink in the common liquid chamber 31 from the vibration plate 19 without being passed through the descenders 34 containing ink having heat conductivity lower than heat conductivity of the metallic plate, and a heating efficiency is improved.

Moreover, as shown in FIG. 5, since the heater 26 extends along a direction in which pressure chambers 33 containing the ink are arranged, the heater 26 heats the ink in all channels evenly, and it is possible to prevent an occurrence of a difference in viscosity of ink among ink droplets which are jetted from the nozzle holes 18*a*. Furthermore, since two heaters 26 are arranged on both sides (one heater 26 on each side) sandwiching all the channels of the channel unit 11 in a plan view, the ink in the channels of the channel unit 11 is heated evenly and promptly, and it is possible to heat the entire ink evenly, and to shorten a heating time. When the ink-jet head 10 is reciprocated, portions on both sides of the scanning direction are susceptible to be cooled by wind generated by a movement. Therefore, by arranging the two heaters 26 to be separated on two sides of the scanning direction, it is possible to heat effectively locations which are susceptible to be cooled.

Furthermore, since the heating element 27 of the heater 26 is adhered to the vibration plate 19 directly by a film forming method such as the aerosol deposition method, and not adhered by an adhesive or the like, the vibration plate 19 is heated directly without the heat being passed through an adhesive which normally has a low heat conductivity, and the heating efficiency is improved. Moreover, since the film forming method for forming the heating element 27 of each of the heaters 26 is same as the film forming method for forming the piezoelectric body 23, it is possible to form the piezoelectric body 23 and the heating element 27 by the same film forming method, and a manufacturing efficiency is improved.

Figure 13:
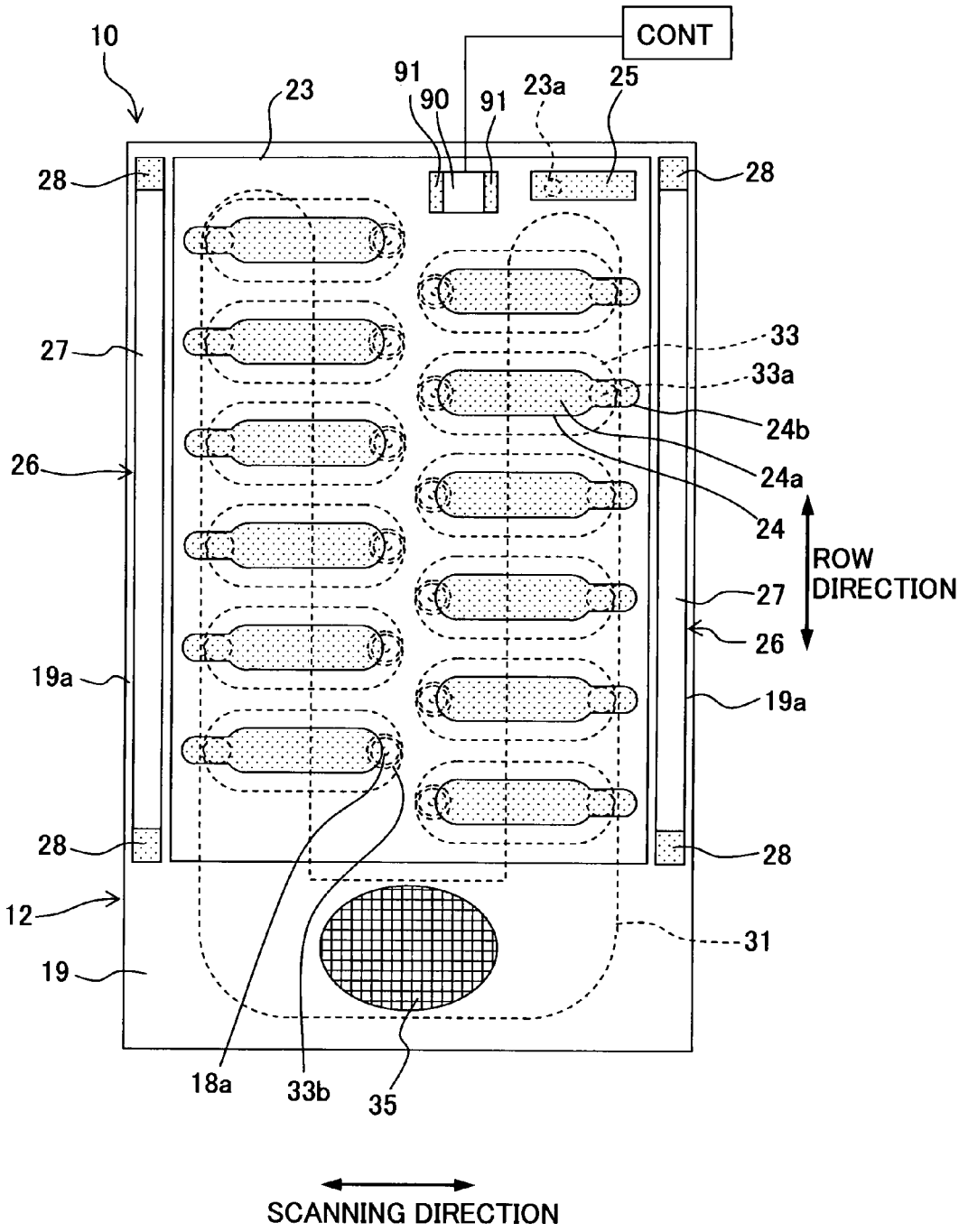
FIG. 13 is a plan view showing a modified embodiment in which a temperature sensor is provided to the ink-jet head in the first embodiment.
Figure 14:
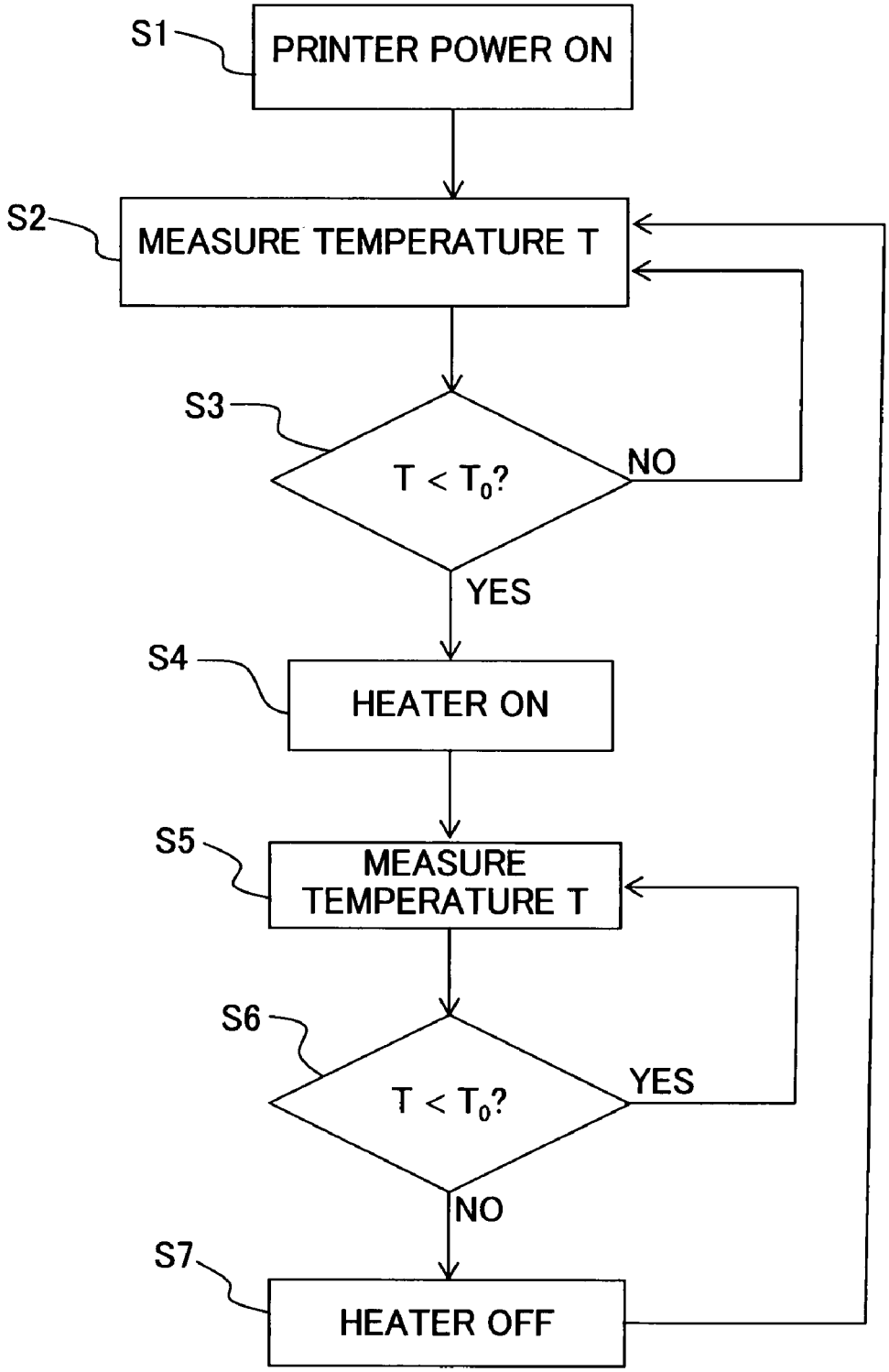
FIG. 14 is a flowchart showing a procedure for controlling an operation timing of a heater by the ink-jet printer of the present invention.

Next, a procedure for controlling an operation timing of the heater 26 in the ink-jet printer 1 will be described below by referring to a flowchart in FIG. 14. Firstly, when a user puts ON a power supply of the printer (step S1), a temperature is measured by a temperature sensor 90 which is provided inside the ink-jet printer 1 (step S2). The temperature sensor may be provided on an electronic substrate (not shown in the diagram) on the flexible flat cable 13, or for easy connection with the flexible flat cable 13, may be provided, for example, on the piezoelectric body 23 as shown in FIG. 13. In this case, it is preferable to arrange the temperature sensor 90 such that electrodes 91 for connecting the flexible flat cable 13 and a temperature sensor 90 is arranged on the same plane on which the terminals 24*b* of the individual electrode 24, and the surface electrode 25 and the electrodes 28 of the heaters 26 are arranged. By making such an arrangement, it is possible to connect easily and stably these electrodes by one flexible flat cable 13.

When the temperature sensor 90 measures the temperature, a controller "cont" which is provided to the ink-jet printer 1, and connected to the temperature sensor 90 makes a judgment of whether to operate the heater 26 based on a result of the temperature measurement (step S3). Concretely, the controller cont makes a judgment whether a temperature T measured by the temperature sensor 90 is less than a predetermined temperature $T_0$ which is set in advance in the controller cont. When the temperature T is less than the predetermined temperature $T_0$ (Yes at step S3), since the temperature of the ink is required to be raised up to the predetermined temperature $T_0$, the controller cont starts the operation of the heater 26 by applying an electric potential to the electrodes 28 of the heater 26 by controlling an electric potential applying section (not shown in the diagram) (step S4). On the other hand, when the temperature T measured by the temperature sensor 90 is not less than the predetermined temperature $T_0$ (No at step S3), steps S2 and S3 are repeated till the measured temperature T becomes less than the predetermined temperature $T_0$.

After the heater 26 has started heating at step S4, the temperature sensor 90 continues measuring the temperature T (step S5) The controller cont makes a judgment of whether to continue the operation of the heater 26, based on the temperature T measured by the temperature sensor 90 at step S5 (step S6). Concretely, the controller cont makes a judgment of whether the temperature T measured by the temperature sensor 90 is less than the predetermined temperature $T_0$. When the temperature T is less than the predetermined temperature $T_0$, the controller cont continues the operation of the heater 26 by applying the electric potential to the electrode 28 of the heater 26 by controlling the electric potential applying section (not shown in the diagram). The step S5 and step S6 are continued till the temperature of the ink becomes the predetermined temperature $T_0$ or more. On the other hand, when the temperature T measured by the temperature sensor 90 is not less than the predetermined temperature $T_0$ (No at step S6), the controller cont stops the operation of the heater 26 by stopping application of the electric potential to the electrode 28 of the heater 26 by controlling the electric potential applying section (step S7). Even thereafter, the temperature sensor 90 continues to measure the temperature, and a process from step S2 (onward) is repeated till the power supply of the printer is put OFF by the user.

When the heater 26 is controlled according to the procedure described above, even when the viscosity of the ink is increased during the operation of the ink-jet printer 1 due to a change in an environmental temperature, it is possible to heat the ink by the heaters 26 while operating the printer 1. The temperature measurement by the temperature sensor 90 may be carried out at a predetermined time interval, and not continually, from a time when the power supply of the printer is put ON till the power supply is put OFF.

Figure 7:
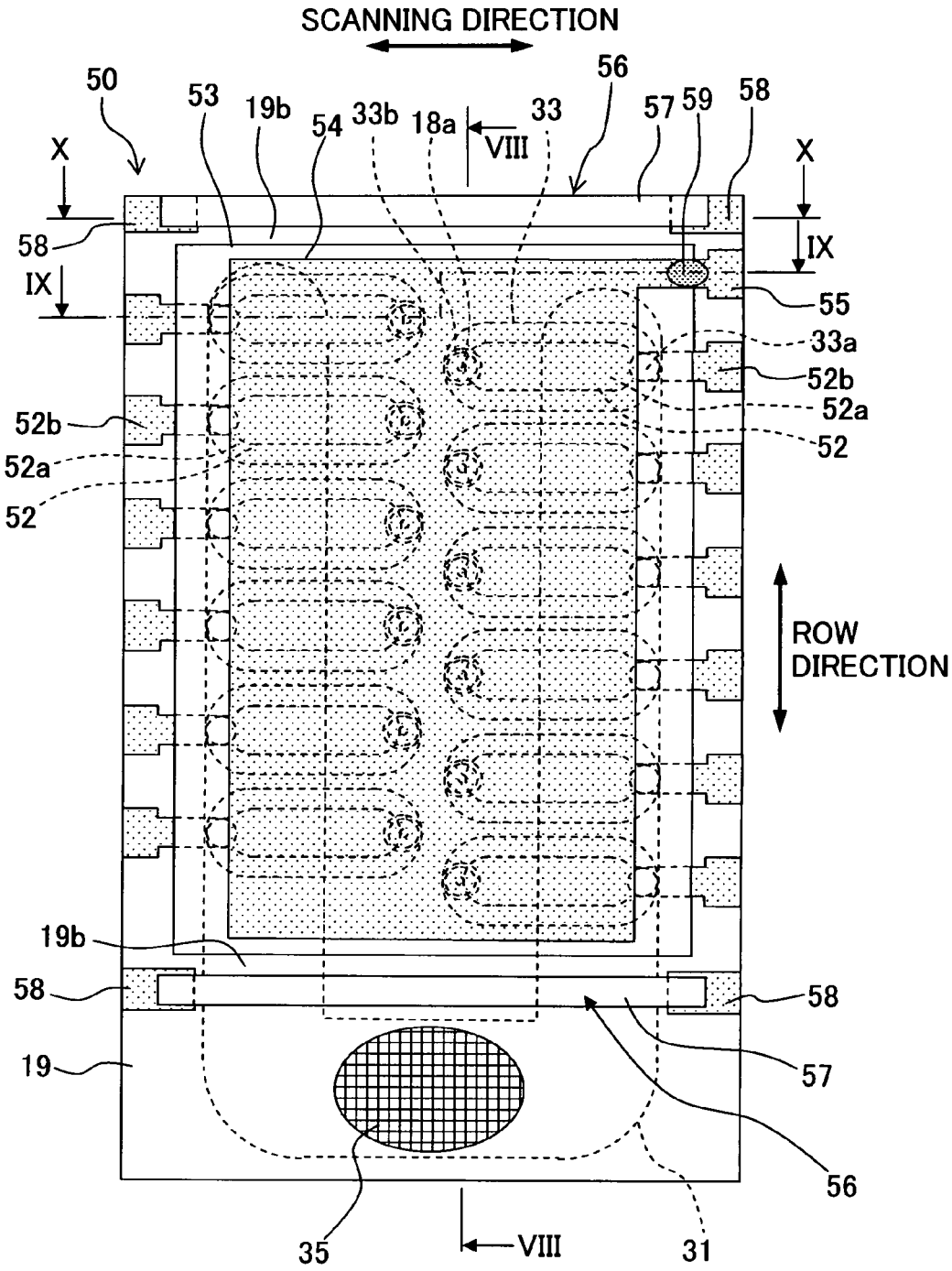
FIG. 7 is a plan view of an ink-jet head according to a second embodiment.
Figure 8:
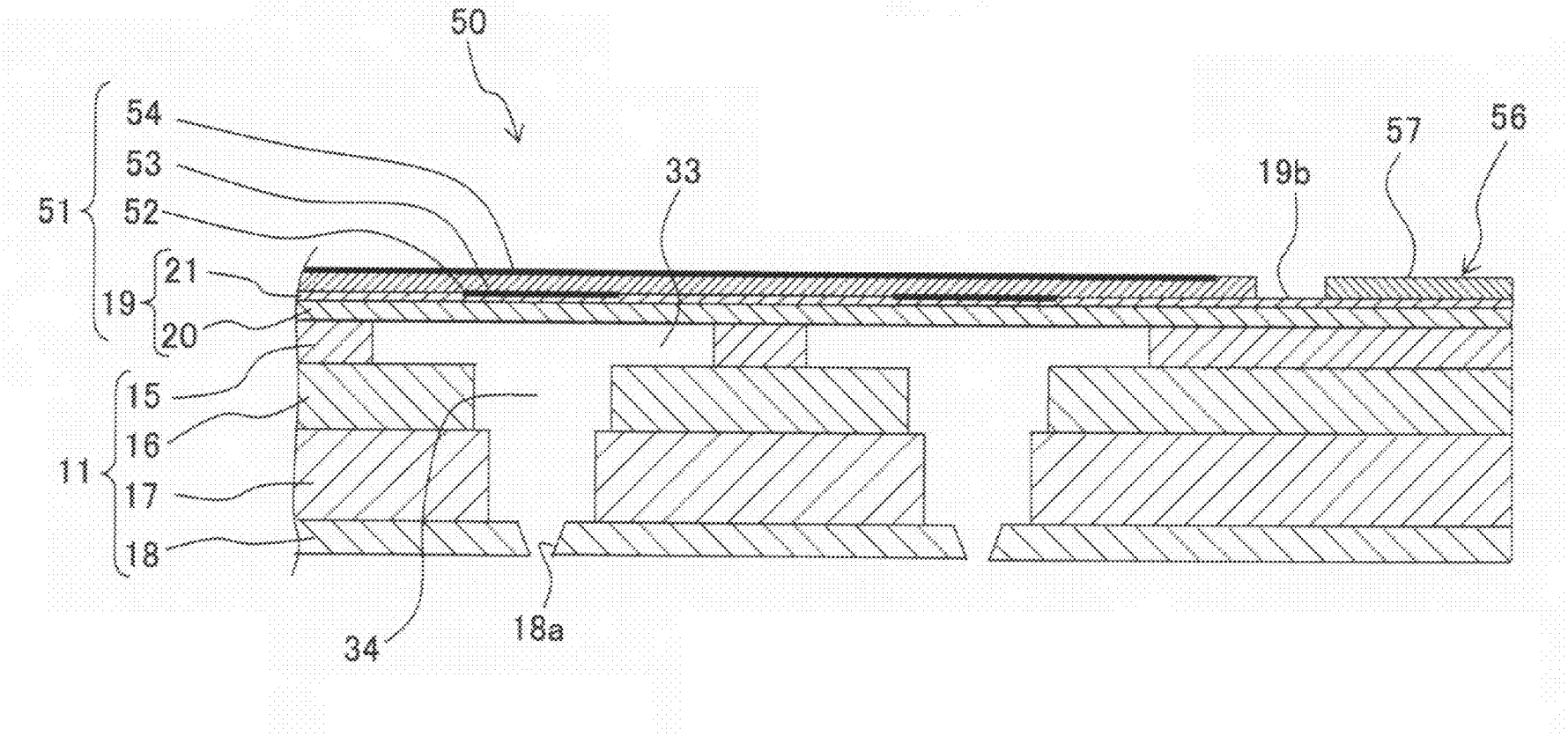
FIG. 8 is an enlarged cross-sectional view of main components, taken along a line VIII-VIII in FIG. 7.
Figure 9:
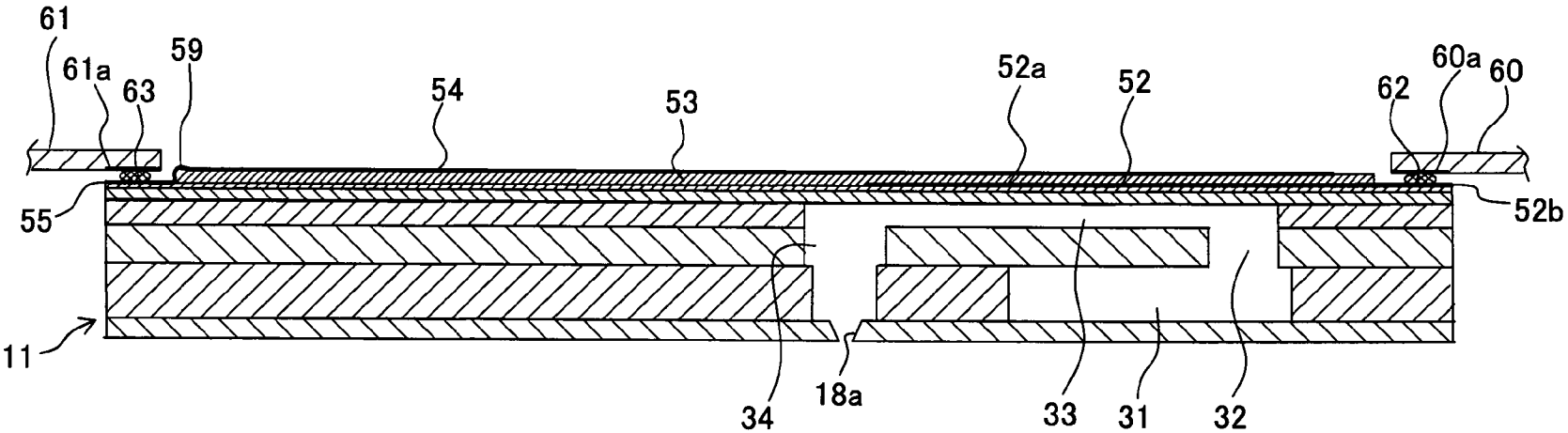
FIG. 9 is a cross-sectional view taken along a line IX-IX in FIG. 7.
Figure 10:
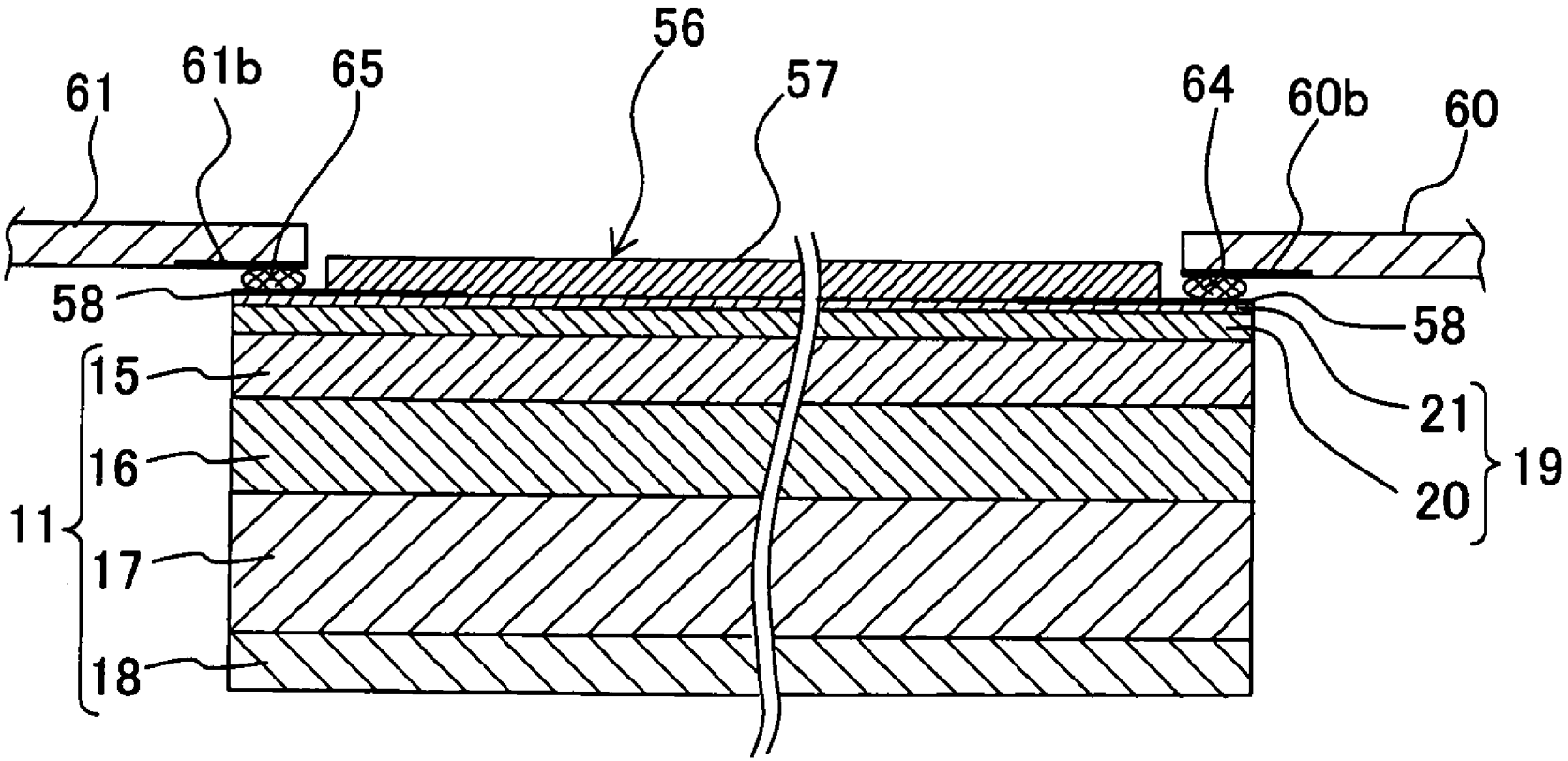
FIG. 10 is a cross-sectional view in which a part of a cross-sectional view taken along a line X-X in FIG. 7 is broken.

Next, a second embodiment of the present invention will be described below by referring to FIG. 7 to FIG. 10. FIG. 7 is a plan view of an ink-jet head 50 of the second embodiment. FIG. 8 is an enlarged cross-sectional view of main components, taken along a line VIII-VIII in FIG. 7. FIG. 9 is a cross-sectional view taken along a line XI-IX in FIG. 7. FIG. 10 is a cross-sectional view in which a part of a cross-sectional view taken along a line X-X in FIG. 7 is broken. Since the channel unit 11 and the vibration plate 19 in the second embodiment are similar as in the first embodiment, the same reference numerals are used for the components, and detailed description thereof is omitted. As shown in FIG. 7 to FIG. 9, a piezoelectric actuator 51 includes a plurality of individual electrodes (first electrodes) 52 formed by printing, in two rows, each of which corresponds to each of the pressure chambers 33 on the upper surface of the vibration plate 19. Each of the individual electrodes 52 includes main body portion 52*a* having a similar shape as of the shape of the pressure chamber 33 in a plan view, and an area smaller than the area of the pressure chamber 33, and a terminal 52*b* which extends from the main-body portion 52*a* up to one end of the vibration plate 19 in the scanning direction. Moreover, on the vibration plate 19, a terminal 55 for the common electrode (second electrode) 54 which will be described later is formed by printing at desired locations in line with the terminals 52*b*. Furthermore, on the vibration plate 19, electrodes 58 for heaters 56 which will be described later are formed at desired locations on both sides of a row direction in line with the terminals 52*b*, and both sides of the scanning direction. In other words, the terminals 52*b* and 55, and the electrodes 58 are formed on the same plane.

A piezoelectric body 53 in the form of a sheet is formed on an upper surface of the individual electrodes 52. The piezoelectric body 53 is formed such that the piezoelectric body 53 covers the main-body portion 52*a* of each of the individual electrodes 52, and that does not cover end portions of the terminals 52*b* of the individual electrodes 52. Moreover, the piezoelectric body 53 is formed such that the piezoelectric body does not cover portions along both sides of the row direction of the vibration plate 19, and these portions of the vibration plate 19 which are not covered by the piezoelectric body 53 are uncovered areas 19*b*. The common electrode 54 which is arranged continuously with respect to the plurality of pressure chambers 33 is formed by printing, on an upper surface of the piezoelectric body 53. The common electrode 54 is in electric conduction with the terminal 55 which is formed in advance on the vibration plate 19 by an electroconductive member 59 in the form of a paste.

In each of the uncovered areas 19*b* on both sides of the row direction of the vibration plate 19, a heating element 57 having a band shape extends along the scanning direction, having a distance (interval) from the piezoelectric body 53, and both end portions of the heating element 57 are formed on the electrodes 58 which are formed in advance on the vibration plate 19. In other words, the structure is such that each of the heaters 56 is formed by (includes) the heating element 57 and the electrodes 58, and the heat is generated by applying the electric current to the heating element 57 by supplying the electric power to the electrodes 58.

As shown in FIG. 9 and FIG. 10, terminals 60*a*, 60*b*, 61*a*, and 61*b* of a pair of flexible flat cables 60 and 61 are connected to be in electric conduction with the terminals 52*b* of the individual electrodes 52, the terminal 55 of the common electrode 54, and the electrodes 58 of the heaters 58, via electroconductive joining materials (members) 62 to 65 such as solder. Furthermore, even in the second embodiment, a temperature sensor 90 may be provided on the piezoelectric body 53 for example, similarly as in the first embodiment. By arranging the terminals 52*b* of the individual electrodes 52, the terminal 55 of the common electrode 54, the electrodes 58 of the heaters 56, and electrodes 91 of the temperature sensor 90 on the same plane, it is possible to join (connect) these electrodes easily and stably by the flexible flat cables 60 and 61. A procedure for controlling an operation timing of the heaters 56 is similar as in the first embodiment.

According to the abovementioned structure, the heating element 57 of each of the heaters 56 generates heat by being applied with the electric current, and heats the vibration plate 19 directly. Moreover, the heat from the vibration plate 19 is propagated to the ink in the pressure chambers 33, the connecting channels 32, and the common liquid chamber 31 via the pressure chamber plate 15, the connecting channel plate 16, and the manifold plate 17, and the ink is heated. At this time, since the electrodes 58 for applying the electric current to the heating element 57 is independent of the common electrode 52 and the individual electrodes 54 of the piezoelectric actuator 51, it is possible to heat the ink in the channel unit 11 by the heaters 56 even when the piezoelectric actuator 51 is in operation. Moreover, since the heaters 56 are provided in the uncovered areas 19*b*, which is not covered by the piezoelectric body 53, on the vibration plate 19, the heat of the heaters 56 is propagated to the vibration plate 19 without being drawn by the piezoelectric body 53, an efficiency of heat transfer to the ink in the ink channel unit 11 is improved.

Figure 11:
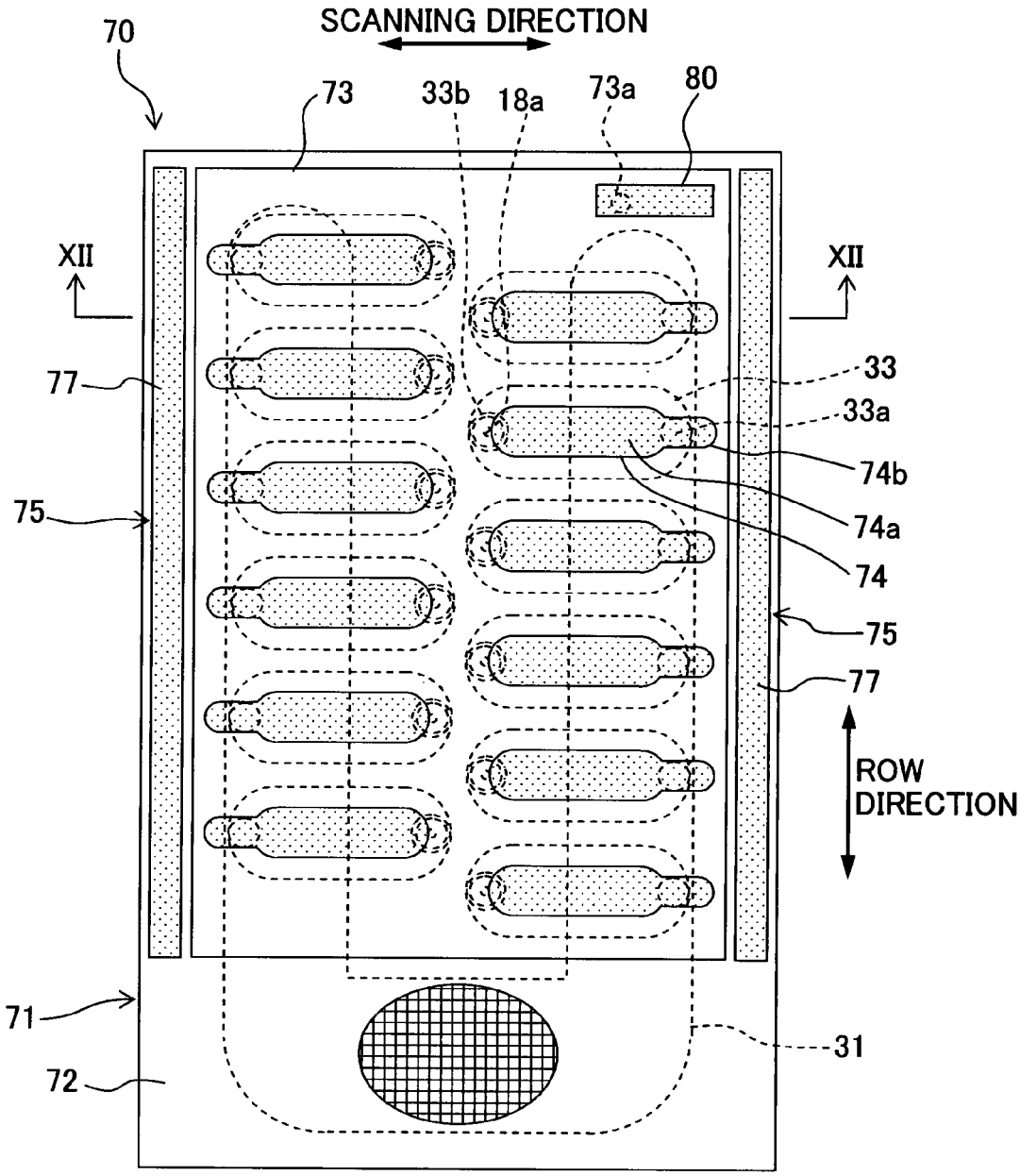
FIG. 11 is a plan view of an ink-jet head according to a third embodiment.
Figure 12:
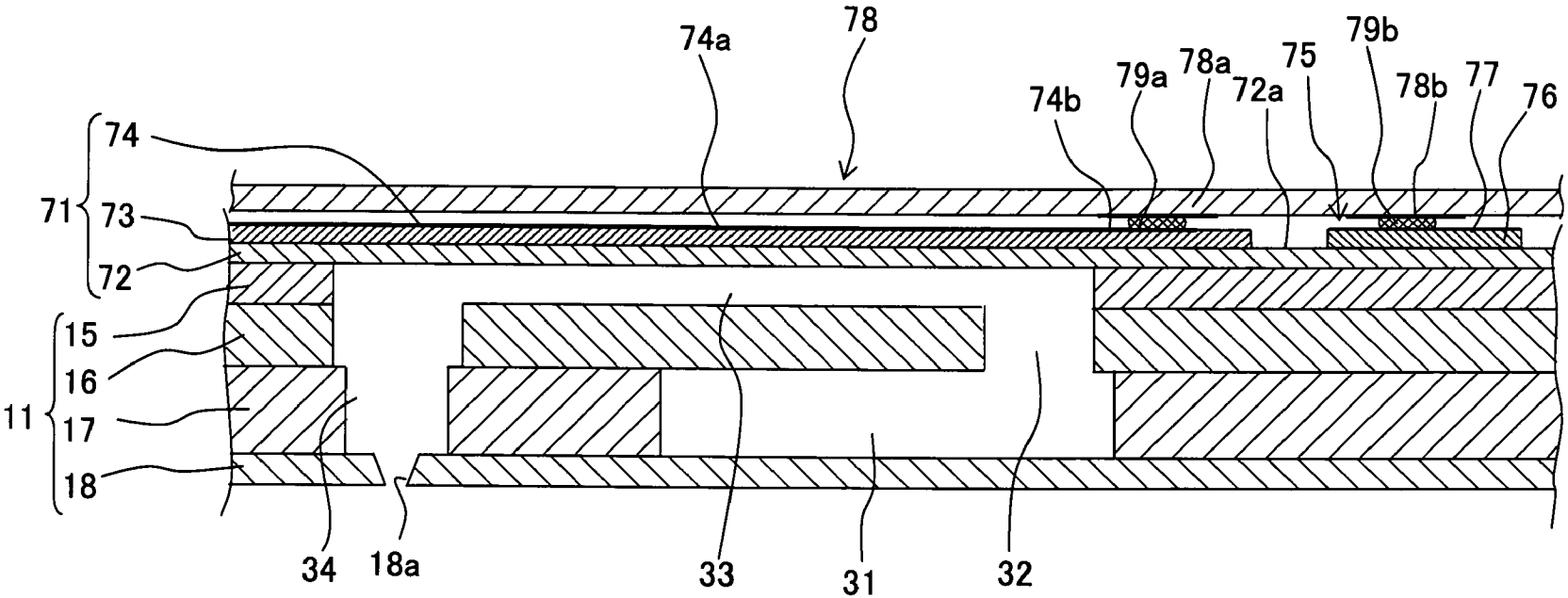
FIG. 12 is an enlarged cross-sectional view of main components, taken along a line XII-XII in FIG. 11.

Next, a third embodiment of the present invention will be described below by referring to FIG. 11 and FIG. 12. FIG. 11 is a plan view of an ink-jet head of the third embodiment. FIG. 12 is an enlarged cross-sectional view of main components, taken along a line XII-XII in FIG. 11. Since the channel unit 11 in the third embodiment is similar to the channel unit 11 in the first embodiment, the same reference numerals are used for the components, and detailed description thereof is omitted. As shown in FIG. 11 and FIG. 12, a piezoelectric actuator 71 includes a vibration plate 72 which is overlapped on the upper surface of the channel unit 11 to close upper openings of the pressure chambers 33. The vibration plate 72 is an electroconductive plate such as a stainless steel plate, and serves as a common electrode (first electrode) of the piezoelectric actuator 71. A piezoelectric body 73 in the form of a sheet made of a ceramics material of lead zirconate titanate (PZT) is formed on an upper surface of the vibration plate 72. The piezoelectric body 73 is formed, in a range such that a uncovered areas 72*a* which are not covered by the piezoelectric body 23 along both sides of the scanning direction of the vibration plate 72 are provided, by a film forming method such as the aerosol deposition method, the sputtering method, the vapor deposition method, and the sol-gel method. A plurality of individual electrodes (second electrodes) 74, each of which is arranged to correspond with each of the pressure chambers 33, are formed in two rows by printing on an upper surface of the piezoelectric body 73. Each of the individual electrodes 74 includes a main-body portion 74*a* having a similar shape as the shape of the pressure chamber 33 in a plan view, and an area smaller than the area of the pressure chamber 33, and a terminal 74*b* which extends from the main-body portion 74*a* up to outside the pressure chamber 33 toward the uncovered area 72*a*.

A heater 75 extends along the row direction of the pressure chambers 33 having a distance from the piezoelectric body 73, in each of the uncovered areas 72*a* of the vibration plate 72. The heater 75 includes a heating element 76 in the form of a band shape which generates heat by being applied with the electric current, and an electrode 77 which is formed on an entire upper surface of the heating element 76. The heating element 76 is formed by adhering directly to the vibration plate 72, a heat generating material made of a material such as graphite, carbon, PG/PBN (pyrolytic graphite/pyrolytic boron nitride), aluminum nitride, or tungsten, by a film forming method such as the aerosol deposition method, the sputtering method, the vapor deposition method, or the sol-gel method. A surface electrode 80 is formed by printing, on the upper surface of the piezoelectric body 73, and the surface electrode 80 is in electric conduction with the vibration plate 72 via an intermediate electroconductive body (not shown in the diagram) provided in a through hole 73*a* of the piezoelectric body 73.

Terminals 78*a* and 78*b* of one flexible flat cable 78 are connected to be in electric conduction with the terminals 74*b* of the individual electrodes 74, and the surface electrode 80 and the electrode 77 of the heater 75, via electroconductive joining material (members) 79*a* and 79*b* such as solder. Furthermore, even in the third embodiment, for example, a temperature sensor 90 may be provided on the piezoelectric body 73 similarly as in the first embodiment. By arranging the terminals 74*b* of the individual electrodes 74, the surface electrode 80, the electrode 77 of the heater 75, and electrodes 91 of the temperature sensor 90 on the same plane, it is possible to connect these electrodes easily and stably by one flexible flat cable 78. A procedure for controlling an operation timing of the heater 75 is similar as in the first embodiment.

According to the abovementioned structure, since the vibration plate 72 serves as an electrode for the heater 75, and the electric current is applied to the heating element 76 over a substantial area, between the vibration plate 72 and the electrode 77 formed on the entire upper surface of the heating element 76, the heating efficiency of the heater 75 is improved. Moreover, since the vibration plate 72 serves as a common electrode of the piezoelectric actuator 71, it is possible to reduce the manufacturing steps.

As it has been described above, the liquid transporting apparatus and the ink-jet printer according to the present invention have an excellent effect of the improvement in the degree of freedom of the operation timing of the heater, and improvement in the heating efficiency of the liquid by the heater, and is useful when applied to the ink-jet printer or the like. For example, when used in an ink-jet printer in which a UV ink having a viscosity higher than the viscosity of a normal ink, since it is possible to lower the viscosity of the UV ink by heating the UV ink with the heater, it is possible to jet the ink stably.

In each of the embodiments described above, the two heaters are arranged on two sides sandwiching all the channels in the channel unit 11. However, an additional heater may be provided. The heating element of the heater was formed on the vibration plate by a film forming method such as the aerosol deposition method, the sputtering method, the vapor deposition method, and the sol-gel method. However the heating element may be formed by a screen printing or may be adhered directly to the vibration plate. Moreover, in each of the embodiments described above, a metallic plate is used for the vibration plate. However, a plate such as a resin plate made of polyimide or the like, an alumina plate, and a silicon plate on an upper surface of which, an oxide layer is formed may be used.

Embodiments in which the present invention is applied to the ink-jet head have been described above. However, the present invention is applicable to any liquid transporting apparatus provided that it is a liquid transporting apparatus which includes pressure chambers formed in channels from a liquid supply port up to liquid jetting ports respectively, a channel unit in which the pressure chambers open, and a piezoelectric actuator which changes individually a volume of each of the pressure chambers, and the piezoelectric actuator includes a vibration plate, a piezoelectric body provided on one surface of the vibration plate, a first electrode provided on a surface of the piezoelectric body on a side of the vibration plate, and a second electrode provided on a surface of the piezoelectric body not facing the vibration plate, and the other surface of the vibration plate is joined to the channel unit to close openings of the pressure chambers, and a heater is provided in an area which is not covered by the piezoelectric body on one surface of the vibration plate, and electrodes of the heater are provided to be independent of the first electrode and the second electrode. In this case, a liquid to be transported is not restricted to ink. For example, the present invention is also applicable to a liquid transporting apparatus which transports a liquid other than ink such as a reagent, a biomedical solution, a wiring material solution, an electronic material solution, for a cooling medium, and for a fuel.

What is claimed is:

1. A liquid transporting apparatus which transports a liquid from a liquid supply port to a plurality of liquid jetting ports, comprising:

a plurality of pressure chambers which are formed, corresponding to the plurality of liquid jetting ports respectively, in channels each from the liquid supply port up to one of the liquid jetting ports;

a channel unit in which the pressure chambers open; and a piezoelectric actuator which changes a volume of each of the pressure chambers individually;

wherein the piezoelectric actuator includes a vibration plate, a piezoelectric body which provided on one surface of the vibration plate, a first electrode provided on a surface, of the piezoelectric body, on a side of the vibration plate, and a second electrode provided, on the piezoelectric body, on the other surface not facing the vibration plate, and which is joined to the channel unit such that the other surface of the vibration plate closes openings of the pressure chambers, and the one surface of the vibration plate has an uncovered area which is not covered by the piezoelectric body, and a heater is provided in the uncovered area, the heater generating heat by being applied with an electric current, and an electrode for applying the electric current to the heater is provided independently of the first electrode and the second electrode of the piezoelectric actuator.

2. The liquid transporting apparatus according to claim 1, wherein the pressure chambers are arranged along a predetermined direction in a plan view, and the heater extends in the predetermined direction at a position beside each of the pressure chambers in a plan view.

3. The liquid transporting apparatus according to claim 1, wherein the channel unit includes a common liquid chamber which communicates with the liquid supply port; and each of the pressure chambers has an inflow hole, at one end portion thereof, which communicates with the common liquid chamber, and has an outflow hole, at the other end portion thereof, which communicates with one of the liquid jetting ports; and the heater is provided closer to the one end portion of each of the pressure chambers, than the other end portion of each of the pressure chambers.

4. The liquid transporting apparatus according to claim 3, wherein the common liquid chamber is arranged at a side of the heater such that the common liquid chamber overlaps with the inflow hole of each of the pressure chambers in a plan view, and that the communication liquid chamber does not overlap with the outflow hole of each of the pressure chambers in a plan view.

5. The liquid transporting apparatus according to claim 1, wherein the heater includes a heating element which is formed of a heat generating material generating heat by being applied with the electric current, and which is provided on a side of the one surface of the vibration plate; and the electrode for applying the electric current to the heater is provided as a plurality of electrodes of the heater which apply the electric current to the heating element on a surface, of the heating element, on a surface thereof not facing the vibration plate.

6. The liquid transporting apparatus according to claim 5, wherein the one surface of the vibration plate is non-conductive at least at a portion thereof at which the heating element is formed.

7. The liquid transporting apparatus according to claim 1, wherein the vibration plate is made of an electroconductive material; the heater includes a heating element formed, of a heat generating material which generates heat by being applied with the electric current, so as to make a contact with the one surface of the vibration plate, and an electrode which is formed over an entire surface of the heating element not facing the vibration plate; and the heating element is heated by a voltage applied between the vibration plate and the electrode of the heater.

8. The liquid transporting apparatus according to claim 5, wherein the second electrode and the plurality of electrodes of the heater are arranged on a same plane.

9. The liquid transporting apparatus according to claim 5, wherein a surface electrode which is in electric conduction with the first electrode is arranged on a same plane as the second electrode and the plurality of electrodes of the heater.

10. The liquid transporting apparatus according to claim 5, wherein the heating element is formed by adhering the heat generating material to the one surface of the vibration plate; and the piezoelectric body is formed by adhering a piezoelectric material to the one surface of the vibration plate; and a film forming method for forming the heating element is same as a film forming method for forming the piezoelectric body.

11. The liquid transporting apparatus according to claim 10, wherein the film forming method is an aerosol deposition method.

12. The liquid transporting apparatus according to claim 1, wherein the heater is provided as two heaters arranged to sandwich all the channels of the channel unit in a plan view.

13. The liquid transporting apparatus according to claim 1, wherein the vibration plate serves as the first electrode.

14. An ink-jet printer comprising:

the liquid transporting apparatus, as defined in claim 12; and a moving mechanism which moves the liquid transporting apparatus in a direction in which the two heaters are separated.

15. An ink-jet printer comprising:

the liquid transporting apparatus, as defined in claim 1;

a controller which controls the heater; and a connecting cable which electrically connects the controller and the liquid transporting apparatus.

16. The ink-jet printer according to claim 15, wherein the connecting cable is connected to the electrode for applying the electric current to the heater provided in the uncovered area.

17. The ink-jet printer according to claim 15, wherein the liquid transporting apparatus further includes a temperature sensor; and the controller controls the heater based on a temperature measured by the temperature sensor.

* * * * *